US006347473B1

(12) United States Patent
Buffoli

(10) Patent No.: US 6,347,473 B1
(45) Date of Patent: Feb. 19, 2002

(54) SAFETY DEVICE FOR REVOLVERS

(75) Inventor: Angelo Buffoli, Brescia (IT)

(73) Assignee: Armi San Marco S.r.l. (IT)

( * ) Notice: Subject to any disclaimer, the term of this patent is extended or adjusted under 35 U.S.C. 154(b) by 0 days.

(21) Appl. No.: 09/356,761

(22) Filed: Jul. 19, 1999

(51) Int. Cl.[7] ..... F41A 17/00
(52) U.S. Cl. ..... 42/66; 42/70.08
(58) Field of Search ..... 72/66, 70.08, 70.11, 72/70.01, 70.06

(56) References Cited

U.S. PATENT DOCUMENTS 473,903 A * 5/1892 Bovy ..... 42/66
600,337 A * 3/1898 Richardson ..... 42/66
3,962,809 A * 6/1976 Lee ..... 42/66
4,133,127 A * 1/1979 Piscetta ..... 42/66
4,316,340 A * 2/1982 Kahn ..... 42/66

FOREIGN PATENT DOCUMENTS

DE 1923395 * 11/1970

* cited by examiner

*Primary Examiner*—Michael J. Carone
*Assistant Examiner*—Denise J Buckley
(74) *Attorney, Agent, or Firm*—McGlew and Tuttle, P.C.

(57) ABSTRACT

An automatic safety device for the firing hammer of revolvers, which includes a safety bolt (22) arranged within the profile of the firing hammer, contained and sliding in a cavity (21) which is provided in the firing hammer proper, connected to the trigger in response to the movements of the firing hammer and of the trigger between an inactive position of noninterference with the movement of the firing hammer from the arming position to the position of percussion, and an active position of stopping the firing hammer to inhibit its percussion action.

14 Claims, 2 Drawing Sheets

SAFETY DEVICE FOR REVOLVERS

FIELD OF THE INVENTION

The present invention pertains to revolvers and more specifically an automatic safety device for such firearms.

BACKGROUND OF THE INVENTION

Safety devices that are able to intercept the firing hammer during its course from the armed position to the firing position to prevent its percussion action and thus to avoid accidental firing of ammunition have already been proposed and adopted into the sector of revolvers or breech-loading pistols. In fact, it may happen that the firing hammer is uncontrollably unhooked from the armed position following a dropping of the gun due to a mishandling by the user, to damage to the release means of the firing hammer, causing the involuntary firing of a shot.

The prior-art devices generally comprise at least one means for intercepting and stopping the firing hammer, which is joined to same on the front and/or on the side, outside profile, changing its traditional outer appearance.

SUMMARY AND OBJECTS OF THE INVENTION

On the contrary, the scope of the present invention is to provide a revolver with an automatic safety device, which, besides being able to effectively perform the task for which it is provided and contained entirely in the firing hammer, except for a minimum part, does this particularly desirable and sought-after task when efficient guns are to be reproduced with the most traditional appearance possible. And, actually, the arrangement of the device in the firing hammer, within its profile, does not lead to any change in the outer appearance of the firing hammer, which, thus, makes it possible to maintain the most traditional shape.

According to the invention, a revolver firing hammer automatic safety device is provided with a stock and a firing hammer hinged on the stock. The hammer is provided with a mounting tooth and with an intermediate safety tooth. The hammer rotates between an arming position and a percussion position. A trigger has a firing pin that interacts with the mounting tooth for stopping the firing hammer in the arming position or with the safety tooth for stopping the firing hammer in an intermediate safety position. A safety bolt is arranged within the profile of the firing hammer, contained and sliding in a the cavity made in the firing hammer proper, connected to the trigger and movable in response to the movements of the firing hammer and of the trigger between an inactive position of noninterference with the movement of the firing hammer from the arming position to the position of percussion, and an active position of positive stopping of the firing hammer in order to inhibit its action of percussion when the firing hammer is unhooked from the mounting position without trigger.

The safety bolt may have a top head protruding from the cavity on the front of the firing hammer toward the stock of the gun. The head of the bolt is at a level of a hole or cavity provided in the stock when the safety bolt is in the inactive position, with the firing hammer in the percussion position, and at a level of a solid part of the stock, resting against same when the bolt is in the active position.

The safety bolt may have a hinged foot at one end of a rod which is connected at the opposite end to an arm which is integral with the trigger on the rear of the trigger.

The firing hammer, on its part with the mounting tooth and the intermediate safety tooth, may have an additional cavity which is intended to accommodate the firing pin of the trigger when the firing hammer is depressed and the safety bolt is in the active position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
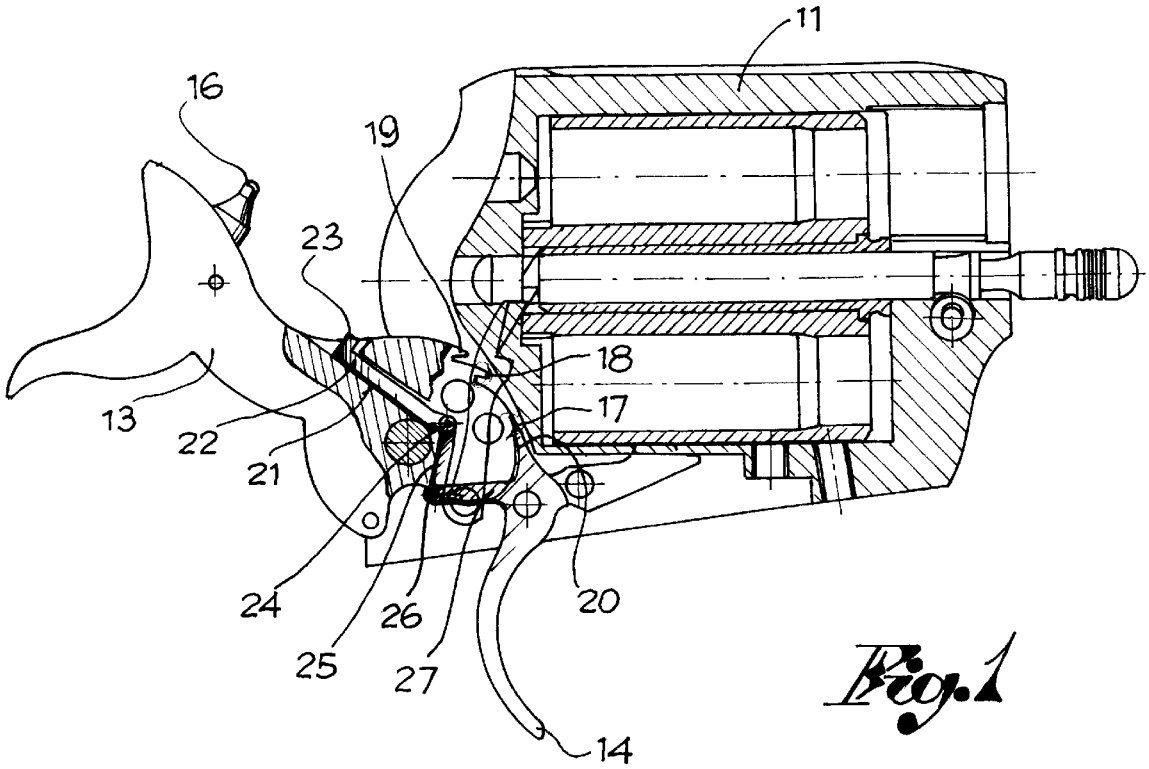
FIG. 1 is a sectional view showing part of a revolver with the firing hammer hooked in the armed position.

Referring to the drawings in particular, only some of the elements of a revolver are shown in the drawings, precisely part of the stock 11 which carries the cylinder 12 for the ammunition, the firing hammer 13, the trigger 14, and the bolt 15 for the rotation of the cylinder 12.

The firing hammer 13 is mounted on the stock 11 and rotates on an axis 13' between an arming position and a percussion and firing position. On the front, the firing hammer has a firing pin 16 and is stressed by a spring (not shown), which tends to move it and to keep it usually in the position of percussion. The arming position is obtained with a moving of the firing hammer in opposition to the spring.

In the lower part, along its circular profile, the firing hammer 13 has a mounting tooth 17, a safety tooth 18 and an additional cavity 19, in order from the bottom.

The trigger 14 is hinged to the stock 11 on an axis 14', which is parallel to the axis 13' of the firing hammer 13, and it has a firing pin 20 intended to intercept and engage the mounting tooth 17 for stopping the latter in the arming position (FIG. 1). The firing pin 20 of the trigger 14 may also intercept the safety tooth 18 to stop the firing hammer 13 in an intermediate safety position (FIG. 4) if the firing hammer is armed incompletely, or in case of a disconnection of the firing pin of the trigger from the mounting tooth 17 of the firing hammer.

A cavity 21, in which is contained the safety device of the present invention, is provided in the firing hammer 13.

This device comprises a safety bolt 22 having a head 23, which protrudes from the cavity 21 in the front of the firing hammer towards the stock 11 of the gun, and a hinged foot at 24 at one end of a connecting rod 25, whose opposite end is hinged at 26 to an arm 27 integral with the trigger 14, in the rear of same. The safety bolt 22 may be moved longitudinally between an inactive position and an active position depending on the relative positions of the firing hammer 13 or the trigger 14. In the inactive position, the head 23 of the safety bolt 22 is at a level so as not to meet a solid part of the stock 11, but rather a hole or cavity 11' of same. In the active position, the head 23 of the safety bolt 22 is, however, at a level of a solid part 11' of the stock, resting against same.

Figure 2:
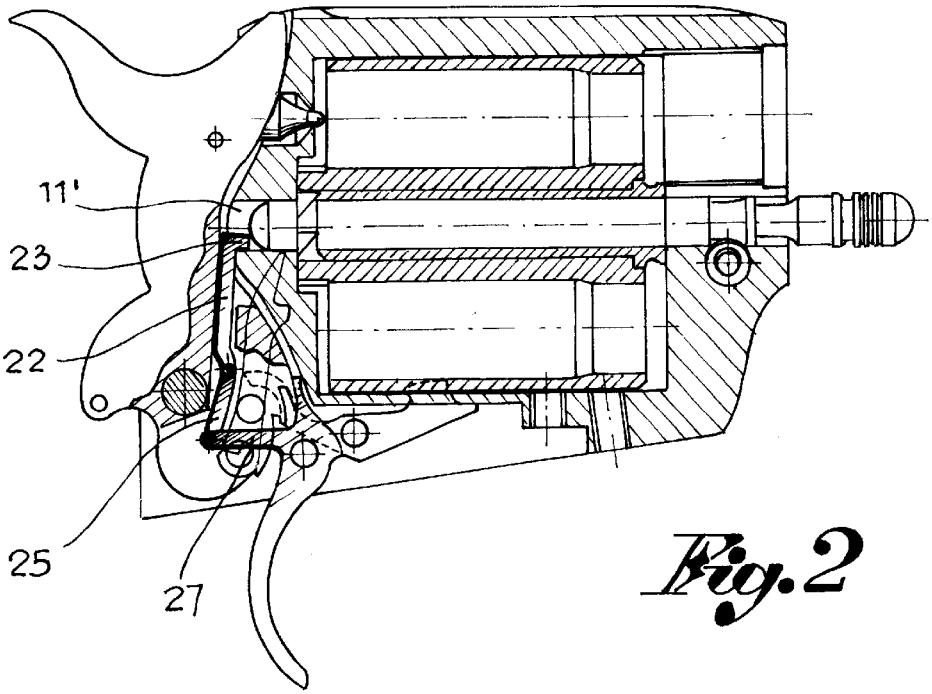
FIG. 2 is a sectional view showing part of the revolver of FIG. 1, but with the firing hammer unhooked in the firing position.

When the firing hammer 13 passes from the arming position, in which it is held back by the firing pin 20 of the trigger which engages with the mounting tooth 17 of the firing hammer (FIG. 1), to the position of percussion (FIG. 2), which is usually controlled by the trigger 14, the safety bolt 22 is arranged in the inactive position, in which its head 23 is at the level of the cavity or hole 11' of the stock 11 as shown in FIG. 2. Under this condition, the percussion pin is able to perform its function for the firing of ammunition.

Figure 4:
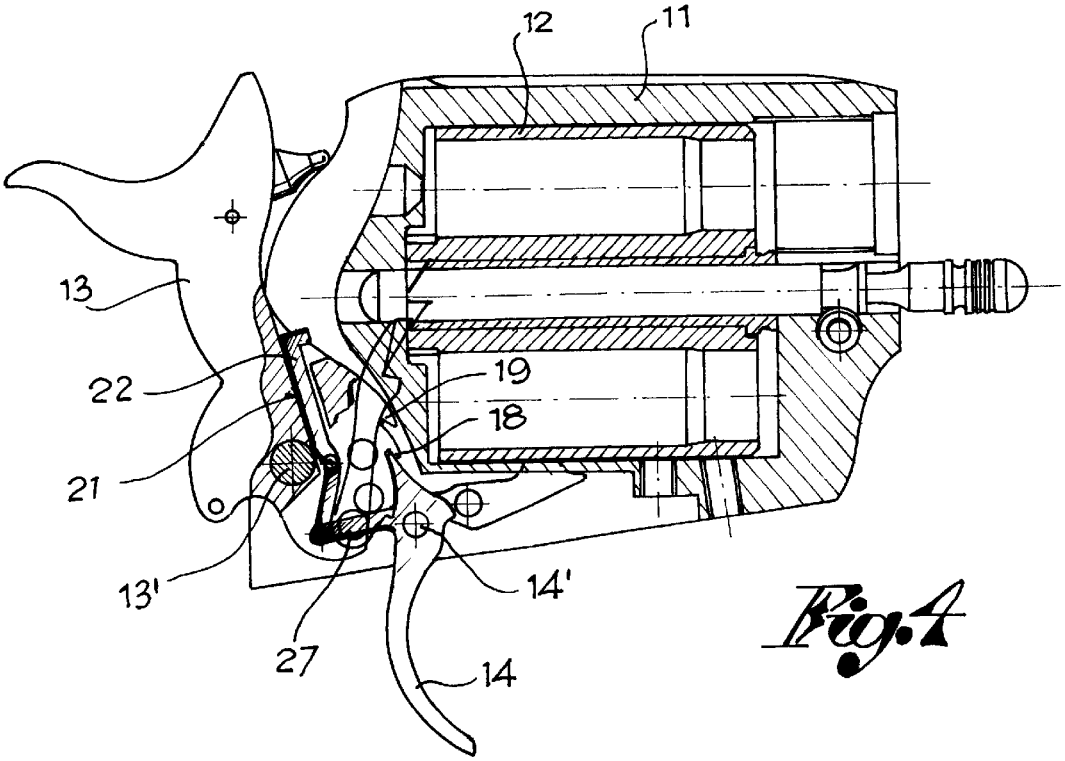
FIG. 4 is a sectional view showing part of the revolver of FIG. 1 in another intermediate safety position defined by the trigger.

When the firing hammer 13 is in the intermediate safety position, it is stopped and held back by the firing pin 20 of the trigger 14, which will then intercept and engage the safety tooth 18 of the firing hammer as shown in FIG. 4.

Figure 3:
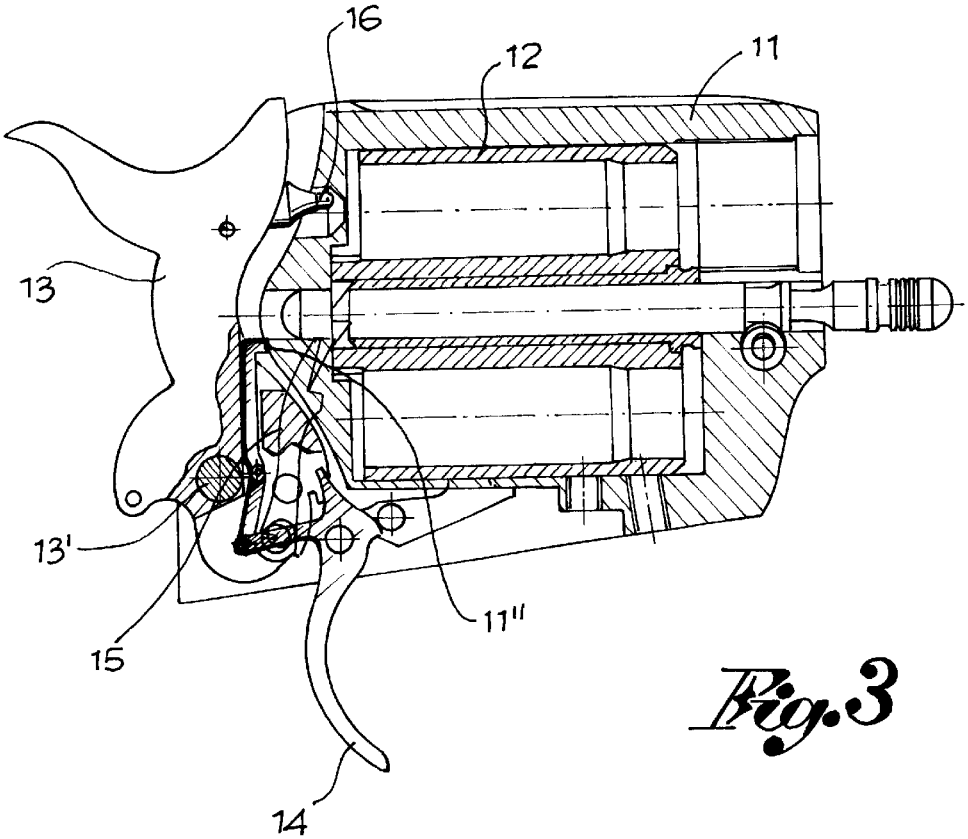
FIG. 3 is a sectional view showing part of the revolver of FIG. 1 in the position of safety defined by the safety device according to the present invention.

Finally, if for any cause or reason the firing hammer is unhooked from the arming position without acting on the trigger, thanks to the movement of the firing hammer and to its connection to the trigger, the safety bolt 22 is arranged in the active position, in which its head 23 rests against a solid part 11" of the stock, as shown in FIG. 3, thus stopping the firing hammer and preventing it from completing its course, as well as preventing the percussion pin from reaching the ammunition. In this position, the firing pin 20 of the trigger is positioned in the additional cavity 19 on the profile of the firing hammer.

While a specific embodiment of the invention has been shown and described in detail to illustrate the application of the principles of the invention, it will be understood that the invention may be embodied otherwise without departing from such principles.

What is claimed is:

1. A revolver firing hammer automatic safety device, comprising:

a stock;

a firing hammer hinged on said stock between an arming position and a percussion position, said firing hammer being provided with a mounting tooth and with an intermediate safety tooth, said firing hammer defining a cavity;

a trigger having a trigger pin interacting with said mounting tooth for stopping the firing hammer in the arming position, said trigger pin also interacting with said safety tooth for stopping said firing hammer in an intermediate safety position; and a safety lever arranged within a profile of said firing hammer, said safety lever being positioned in and sliding in said cavity in said firing hammer, said safety lever being connected to said trigger and movable in response to the movements of said firing hammer and of said trigger between an inactive position of noninterference with the movement of the said firing hammer from the arming position to the position of percussion, and an active position of positive stopping said firing hammer in order to inhibit its action of percussion when said firing hammer is unhooked from the mounting position without trigger, said safety cavity of said firing hammer surrounds a portion of said safety lever.

2. The safety device in accordance with claim 1, wherein said safety lever has a top head protruding from said cavity on a front of said firing hammer toward said stock, said top head of said safety lever being at a level of a hole provided in said stock when said safety bolt is in said inactive position, with said firing hammer in said percussion position, and at a level of a solid part of said stock, resting against said stock when said safety lever is in said active position.

3. The safety device in accordance with the claim 1, wherein said safety lever has a hinged foot at one end linked to a connecting rod, said connecting rod being connected at a opposite end to an arm which is integral with said trigger on rear part of said trigger.

4. The safety device in accordance with claim 1, wherein said firing hammer, on its part with said mounting tooth and said intermediate safety tooth, has an additional cavity which is intended to accommodate said trigger pin of said trigger when said firing hammer is depressed and said safety lever is in said active position.

5. A safety device for a firearm, the device comprising:

a stock;

a firing hammer hinged on said stock between an position and a percussion position, said firing hammer defining a safety cavity;

a trigger having a trigger pin interacting with said firing hammer to selectively block and allow movement of said firing hammer from said position to said percussion position;

a safety lever connected to said trigger and arranged in said safety cavity of said firing hammer, said safety lever being slidable in said cavity between an inactive position and an active position depending on relative positions of said trigger and said firing hammer, said active position of said safety lever blocking movement of said firing hammer into said percussion position, said inactive position of said safety lever allowing movement of said firing hammer into said percussion position, said safety cavity of said firing hammer surrounds a portion of said safety lever.

6. A device in accordance with claim 5, wherein:

said safety lever includes an end which contacts said stock in said active position to block movement of said firing hammer into said percussion position.

7. A device in accordance with claim 6, wherein:

said stock defines a hole for receiving said end of said safety lever when said safely lever is in said inactive position and said firing hammer is in said percussion position, said end of said safety lever extending out of said safety cavity.

8. A device in accordance with claim 5, wherein:

said safety lever is formed of first and second parts that are pivotally connected.

9. A device in accordance with claim 5, wherein:

said firing hammer includes a mounting tooth interacting with said trigger pin to hold said firing hammer in said arming position.

10. A device in accordance with claim 5, wherein:

said firing hammer includes a safety tooth interacting with said trigger pin to hold said firing hammer in an intermediate safety position between said percussion position and said arming position.

11. A device in accordance with claim 5, wherein:

said firing hammer includes a tooth cavity for receiving said trigger pin when said safety lever is in said active position and said firing hammer is moved to said percussion position.

12. A device in accordance with claim 9, wherein:

said firing hammer includes a safety tooth interacting with said trigger pin to hold said firing hammer in an intermediate safety position between said percussion position and said arming position, said firing hammer also includes a tooth cavity for receiving said trigger pin when said safety lever is in said active position and said firing hammer is moved to said percussion position.

13. A device in accordance with claim 5, wherein:

said safety lever is arranged to move into said active position and inhibit action of said firing hammer when said firing hammer is moved to said percussion position without action of said trigger.

14. A device in accordance with claim 5, wherein:

said safety lever moves with said firing hammer between said arming position and said percussion position.

* * * * *